US008630576B2

(12) United States Patent
Kokura et al.

(10) Patent No.: US 8,630,576 B2
(45) Date of Patent: Jan. 14, 2014

(54) IMAGE FORMING SYSTEM, POST PROCESSING APPARATUS, SHEET FEED CONTROL METHOD AND SHEET FEED CONTROL PROGRAM

(75) Inventors: Yasuhide Kokura, Toyohashi (JP); Yasuomi Mitsui, Toyokawa (JP); Takashi Noda, Okazaki (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 908 days.

(21) Appl. No.: 12/053,248

(22) Filed: Mar. 21, 2008

(65) Prior Publication Data

US 2009/0008852 A1 Jan. 8, 2009

(30) Foreign Application Priority Data

Mar. 23, 2007 (JP) ..... 2007-077117

(51) Int. Cl.
*G03G 15/00* (2006.01)

(52) U.S. Cl.
USPC ..... 399/407; 399/397; 399/408; 399/410

(58) Field of Classification Search
USPC ..... 399/407–410, 397
See application file for complete search history.

(56) References Cited

U.S. PATENT DOCUMENTS

| | | | | |
|---|---|---|---|---|
| 6,339,685 | B1 * | 1/2002 | Okamoto et al. | 399/16 |
| 7,711,448 | B2 * | 5/2010 | Fujii et al. | 700/213 |
| 2006/0023245 | A1 * | 2/2006 | Sato et al. | 358/1.13 |

FOREIGN PATENT DOCUMENTS

| | | |
|---|---|---|
| JP | 10-203717 | 8/1998 |
| JP | 11-208979 | 8/1999 |
| JP | 2000-177921 | 6/2000 |
| JP | 2003-307889 | 10/2003 |
| JP | 2006-256710 | 9/2006 |

OTHER PUBLICATIONS

Japanese Notification of Reasons for Refusal mailed Jan. 6, 2009, directed at counterpart JP Application No. 2007-077117; 4 pages.

* cited by examiner

*Primary Examiner* — Matthew G Marini
(74) *Attorney, Agent, or Firm* — Morrison & Foerster LLP

(57) ABSTRACT

An image forming system comprises: an image forming apparatus and a post processing apparatus that performs a post process on sheets each carrying thereon an image printed by the image forming apparatus. In the image forming system, a sheet feeder feeds sheets of a job to be post-processed to a post processing position; a timing judger judges which is before/after, the first timing to finish feeding the last sheet of the job to the post processing position, or the second timing to finish making preparation for a post process; a delaying time calculator calculates a post process execution delaying time that is a time difference between the first timing and the second timing; and a sheet feed controller controls sheet feed timing of the top sheet of a following job by using the calculated post process execution delaying time, if the second timing is after the first timing.

7 Claims, 8 Drawing Sheets

IMAGE FORMING SYSTEM, POST PROCESSING APPARATUS, SHEET FEED CONTROL METHOD AND SHEET FEED CONTROL PROGRAM

This application claims priority under 35 U.S.C. §119 to Japanese Patent Application No. 2007-77117 filed on Mar. 23, 2007, the entire disclosure of which is incorporated herein by reference in its entirety.

BACKGROUND OF THE INVENTION

1. Field of the Invention

The present invention relates to an image forming system comprising an image forming apparatus that prints an image on a sheet and a post processing apparatus that performs a post process such as stapling, punching, folding and etc. on a printed sheet, a post processing apparatus preferably used in the image forming system, a sheet feed control method, and a sheet feed control program.

2. Description of the Related Art

The following description sets forth the inventor's knowledge of related art and problems therein and should not be construed as an admission of knowledge in the prior art.

When an image forming apparatus sequentially prints images on a plurality of sheets, the sheets are individually fed from its sheet feed tray to its printer at a certain sheet interval, then discharged on its sheet discharge tray, which is generally known.

Meanwhile, if a post processing apparatus is connected to such an image forming apparatus and the post processing apparatus performs a post process on the plurality of printed sheets, the post processing apparatus needs a post process time from the start until the end of the post process. Thus, when the top sheet of a following job is fed at a certain sheet interval right after the last sheet of a job to be post-processed, the top sheet of a following job may happen to be fed to a post processing position in the post processing apparatus before a post process is completed, which is inconvenient.

To cope with this issue, an art is disclosed wherein the start of feeding the top sheet of a following job is delayed by a certain fixed time that is required to perform a post process on a job.

Generally, a post process time is changeable depending on a sheet size, a process condition and etc. However, according to the art disclosed in Japanese Unexamined Laid-open Patent Publication No. 11-208979, feeding the top sheet of a following job is delayed by a fixed time, not by an appropriate time adjusted for each job depending on its post process time, which is not very productive.

Further, to cope with this issue, an art is disclosed in Japanese Unexamined Laid-open Patent Publication No. 2006-256710, wherein a process time (T1) and a discharge time (T2) are calculated based on a sheet size and a process condition of a job currently post-processed, and a sheet accumulation time (sheet feed time) calculated based on a sheet size and the number of sheets of a following job, is subtracted from T1+T2 to obtain a job wait time (Ta), and then feeding the top sheet of the following job is delayed by Ta.

With this art disclosed in Japanese Unexamined Laid-open Patent Publication No. 2006-256710, the top sheet of a following job is fed depending on a post process time of a previous job. However, there is still an issue with this art as below.

In order to perform a post process, the post processing apparatus needs preparation. For example, if stapling is performed as a post process, its stapler has to move to an appropriate position to meet a stapling position on sheets, which is specified by a user, and when its stapler finishes moving to an appropriate position, the post processing apparatus can perform a post process. If such preparation is finished before the last sheet of a job to be post-processed arrives at a post processing position, the post processing apparatus would successfully executes the job simply by delaying feeding the top sheet of a following job by a job waiting time (Ta), since the post processing apparatus immediately performs a post process as soon as the last sheet of the job arrives at the post processing position. On the other hand, if such preparation is not finished before the last sheet of a job to be post-processed arrives at a post processing position, the post processing apparatus would not successfully execute the job only by delaying feeding the top sheet of a following job by a job waiting time (Ta), since the top sheet of a following job may happen to be fed to the post processing position before the post processing apparatus completes a post process on the previous job.

The description herein of advantages and disadvantages of various features, embodiments, methods, and apparatus disclosed in other publications is in no way intended to limit the present invention. Indeed, certain features of the invention may be capable of overcoming certain disadvantages, while still retaining some or all of the features, embodiments, methods, and apparatus disclosed therein.

SUMMARY OF THE INVENTION

The preferred embodiments of the present invention have been developed in view of the above-mentioned and/or other problems in the related art. The Preferred embodiments of the present invention can significantly improve upon existing methods and/or apparatuses.

It is an objective of the present invention to provide an image forming system that is capable of appropriately feeding sheets to a post processing apparatus even if preparation of the post processing apparatus for a post process is not finished before the last sheet of a job to be post-processed arrives at the post processing position, without wrongly feeding the top sheet of a following job to the post processing position before the post processing apparatus completes a post process on the previous job, which is inconvenient.

It is another objective of the present invention to provide a post processing apparatus that is preferably used in the image forming system described above.

It is yet another objective of the present invention is to provide a sheet feed control method that appropriately feeds sheets to a post processing apparatus even if preparation of the post processing apparatus for a post process is not finished before the last sheet of a job to be post-processed arrives at the post processing position, without wrongly feeding the top sheet of a following job to the post processing position before the post processing apparatus completes a post process on the previous job.

It is still yet another objective of the present invention is to provide a sheet feed control program stored in a computer readable recording medium to make a computer of the post processing apparatus execute processing by the sheet feed control method.

According to a first aspect of the present invention, an image forming system comprises:

an image forming apparatus that is equipped with a printer that prints an image on a sheet; and a post processing apparatus that performs about each job, a post process on one or a plurality of sheets each carrying thereon an image printed by the image forming apparatus, and wherein:

a sheet feeder that feeds a sheet of a job to be post-processed to a post processing position in the post processing apparatus;

a timing judger that judges which is before/after, the first timing to finish feeding the last sheet of the job to the post processing position so that a post process could be performed, or the second timing to finish making preparation of the post processing apparatus to perform a post process on the job;

a delaying time calculator that calculates a post process execution delaying time that is a time difference between the first timing and the second timing, if the second timing is after the first timing; and a sheet feed controller that controls sheet feed timing of the top sheet of a following job by using the post process execution delaying time calculated by the delaying time calculator, if the timing judger judges that the second timing is after the first timing.

According to a second aspect of the present invention, a post processing apparatus comprises:

one or a plurality of post processors that perform a post process on one or a plurality of sheets each carrying thereon an image printed by an image forming apparatus, about each job;

a feeder that feeds to a post processing position of the post processors, a sheet of a job to be post-processed, which is fed from the image forming apparatus;

a timing judger that judges which is before/after, the first timing to finish feeding the last sheet of the job to the post processing position so that a post process could be performed, or the second timing to finish making preparation of the post processors to perform a post process on the job;

a delaying time calculator that calculates a post process execution delaying time that is a time difference between the first timing and the second timing, if the second timing is after the first timing; and a required sheet interval time determiner that determines a sheet interval time required between the last sheet of the job to be post-processed and the top sheet of a following job, by using the post process execution delaying time calculated by the delaying time calculator, if the timing judger judges that the second timing is after the first timing.

According to a third aspect of the present invention, a sheet feed control method comprise:

feeding to a post processing position of a post processing apparatus that performs a post process about each job, one or a plurality of sheets each carrying thereon an image printed by an image forming apparatus;

judging which is before/after, the first timing to finish feeding the last sheet of a job to be post-processed to the post processing position so that a post process could be performed, or the second timing to finish making preparation of the post processing apparatus to perform a post process on the job;

calculating a post process execution delaying time that is a time difference between the first timing and the second timing, if it is judged that the second timing is after the first timing; and controlling sheet feed timing of the top sheet of a following job by using the post process execution delaying time calculated in the previous step, if it is judged the second timing is after the first timing.

According to a fourth aspect of the present invention, a sheet feed control method comprise:

performing a post process on one or a plurality of sheets each carrying thereon an image printed by an image forming apparatus, about each job by a post processor;

feeding to a post processing position of the post processor, a sheet of a job to be post-processed, which is fed from the image forming apparatus;

judging which is before/after, the first timing to finish feeding the last sheet of the job to the post processing position so that a post process could be performed, or the second timing to finish making preparation of the post processor to perform a post process on the job by the post processor;

calculating a post process execution delaying time that is a time difference between the first timing and the second timing, if it is judged that the second timing is after the first timing; and determining a sheet interval time required between the last sheet of the job to be post-processed and the top sheet of a following job, by using the post process execution delaying time calculated in the previous step, if it is judged that the second timing is after the first timing.

According to a fifth aspect of the present invention, a sheet feed control program stored in a computer readable medium to make a computer of a post processing apparatus execute:

performing a post process on one or a plurality of sheets each carrying thereon an image printed by an image forming apparatus, about each job by a post processor;

feeding to a post processing position of the post processor, a sheet of a job to be post-processed, which is fed from the image forming apparatus;

judging which is before/after, the first timing to finish feeding the last sheet of the job to the post processing position so that a post process could be performed, or the second timing to finish making preparation of the post processor to perform a post process on the job by the post processor;

calculating a post process execution delaying time that is a time difference between the first timing and the second timing, if it is judged that the second timing is after the first timing; and determining a sheet interval time required between the last sheet of the job to be post-processed and the top sheet of a following job, by using the post process execution delaying time calculated in the previous step, if it is judged that the second timing is after the first timing.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims.

BRIEF DESCRIPTION OF THE DRAWINGS

The preferred embodiments of the present invention are shown by way of example, and not limitation, in the accompanying figures, in which.

DETAILED DESCRIPTION OF THE PREFERRED EMBODIMENTS

In the following paragraphs, some preferred embodiments of the invention will be described by way of example and not limitation. It should be understood based on this disclosure that various other modifications can be made by those in the art based on these illustrated embodiments.

Figure 1:
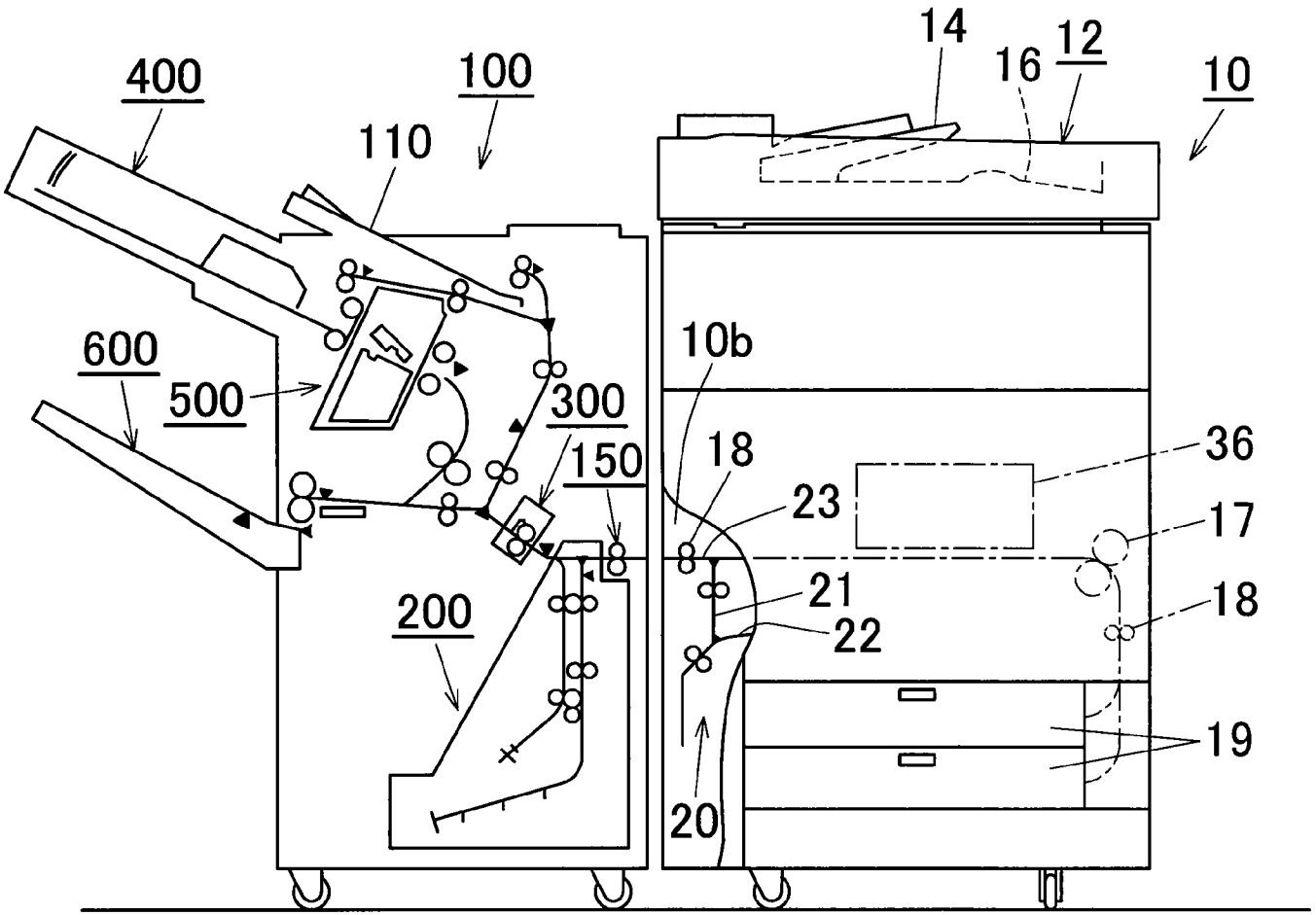
FIG. 1 is a view schematically showing a configuration of an image forming system according to one embodiment of the present invention.

FIG. 1 is a view schematically showing a configuration of an image forming system according to one embodiment of the present invention.

The image forming system comprises an image forming apparatus 10, and a post processing apparatus 100 connected to this image forming apparatus 10. In this embodiment, a MFP (Multi Function Peripheral) that is a multifunctional digital machine collectively having a plurality of functions, such as copying, printing, facsimile, scanning, and etc., is employed as the image forming apparatus 10.

The image forming apparatus 10 is equipped with an automatic document feeder (hereinafter to be referred to as "ADF") 12 on the top. This ADF 12 feeds one or a plurality of sheet(s) of document placed on a tray 14, individually to an image reading position, and then discharges the sheet(s) on a tray 16 after an image on each of the sheets is completely read.

An image reader (not shown in Figure) embedded in the image forming apparatus 10 reads an image on a document that is fed to the image reading position by the ADF 12 or placed on a platen glass (not shown in Figure), and then converts it to image data.

The image forming apparatus 10 comprises a printer 36 that forms a toner image by the electrophotographic method or other based on the image data read out from the document and prints the formed image on sheets, which is heretofore known, and one or a plurality of sheet feed cassette(s) 19 that loads sheets by their sizes. Further, a resist roller 17 is provided in advance of the printer 36 along a sheet transfer route. The resist roller 17 suspends sheets fed from the sheet feed cassette 19 to make its feed timing synchronized with the printer's forming toner images, then lets the sheets fed again when it is synchronized. Sheets are fed via the printer 36 to a sheet discharger 10*b* individually at a sheet interval appropriately adjusted by the resist roller 17, and then transferred to the post processing apparatus 100. Further, a plurality of transfer rollers 18 are provided between the sheet feed cassette 19 and the sheet discharger 10*b*, along a sheet transfer route.

A sheet reverse portion 20 that reverses a printed sheet is provided in the vicinity of the sheet discharger 10*b* of the image forming apparatus 10. In this embodiment, there are a first sheet transfer route 21 that is used for discharging a sheet from the sheet discharger 10*b* after reversing it by the sheet reverse portion 20, a second sheet transfer route 22 is used for circulating a sheet in the image forming apparatus 10 and printing on backside of the sheet (copying on both sides. the sheet carries an image printed on its foreside already) after reversing it by the sheet reverse portion 20, and a third sheet transfer route 23 that is used for discharging a sheet from the sheet discharger 10*b* directly without taking a route via the sheet reverse portion 20. The image forming apparatus 10 selectively switches between the three sheet transfer routes 21, 22 and 23.

In this embodiment, the post processing apparatus 100 selectively performs a post process depending on need, such as folding sheets in two or in three (Z-fold), punching filing holes in sheets, and stapling a bundle of a plurality of sheets, on the sheets discharged from the sheet discharger 10*b* of the image forming apparatus 10 then transferred to the post processing apparatus 100, individually.

Figure 2:
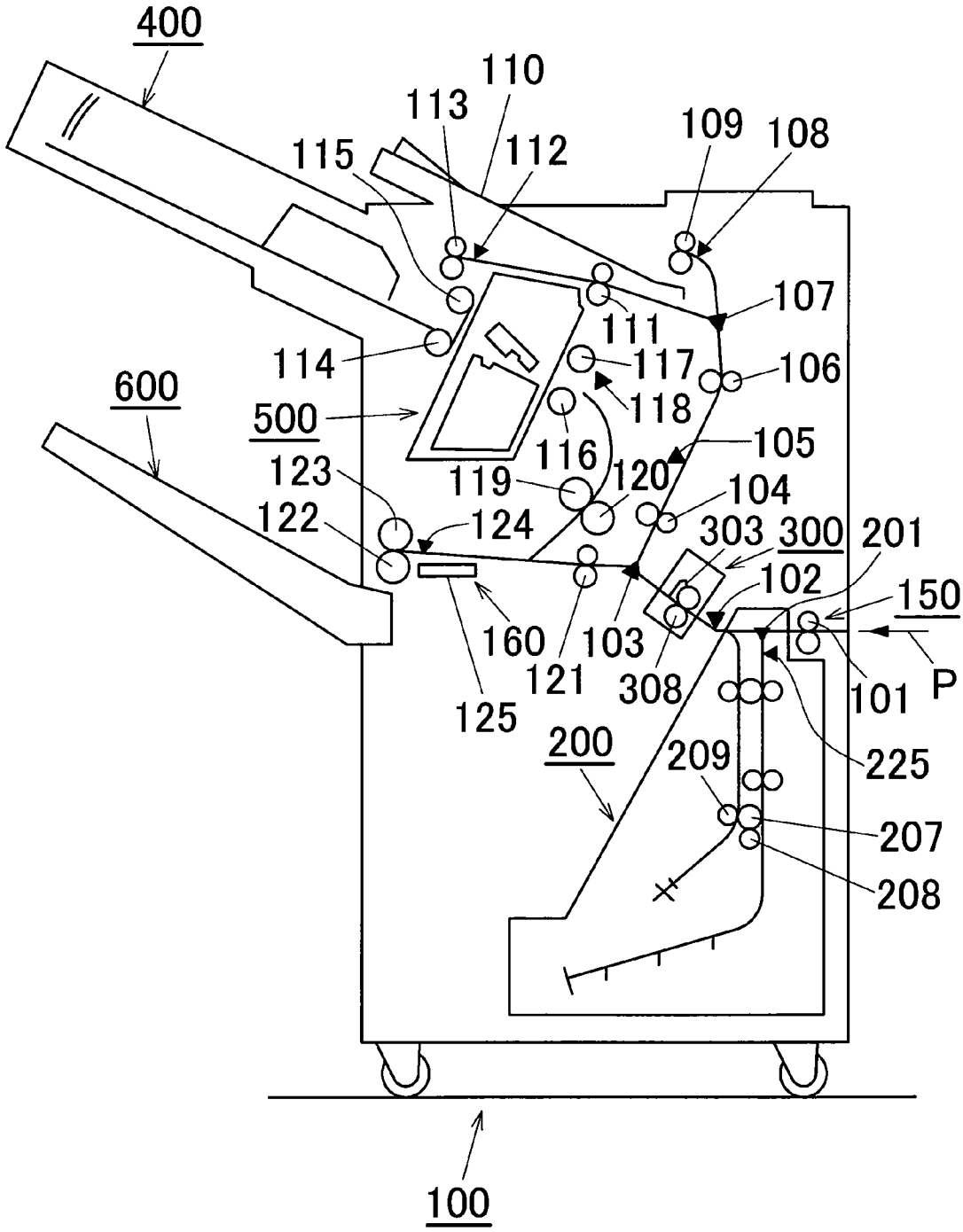
FIG. 2 is a view schematically showing a configuration of a post processing apparatus.

To refer to FIG. 2 for further detailed information, the post processing apparatus 100 comprises a receiving portion 150 that receives sheets P discharged from the sheet discharger 10*b* of the image forming apparatus 10, a folder 200 that folds the sheets P individually transferred, a puncher 300 that punches filing holes in the sheets P individually transferred, a post process tray 400 that accumulates and jogs the sheets P in advance of stapling, a stapler 500 that is provided in the lower stream of the post process tray 400 and staples the bundles of sheets accumulated and jogged by the post process tray 400, an accumulation tray 600 that loads the stapled bundles of sheets and/or the unstapled sheets P, and a discharge tray 110 that accumulates the sheets P discharged from the image forming apparatus 10.

The receiving portion 150 comprises a transfer roller 101 and a guide board (not shown in Figure). The folder 200 comprises a plurality of folding rollers 207, 208 and 209, and the folding rollers 207, 208 and 209 fold sheets P by giving pressure from both sides. Further, the stapler 500 is capable of moving in two directions: a sheet transfer direction in which bundles of sheets accumulated and jogged by the post process tray 400 are transferred, and the other direction that crosses the sheet transfer direction.

Sheets P are transferred by some transfer rollers to the respective portions of the post processing apparatus 100. Transfer rollers 104, 106, 111 are provided along a sheet transfer route to transfer sheets P individually to the post process tray 400. Sheet bundle transfer rollers 114, 115, 116, 117, 119 and 120 are provided along a sheet transfer route to transfer bundles of sheets P from the post process tray 400 to the accumulation tray 600, and a transfer roller 121 is provided along the same sheet transfer route to transfer sheets P directly to the accumulation tray 600. Further, at the end of these sheet transfer routes, a discharge roller 109 is provided to discharge sheets P on the discharge tray 110, a discharge roller 113 is provided to discharge sheets P on the post process tray 400, and discharge rollers 122 and 123 are provided to discharge sheets P or bundles of sheets P on the accumulation tray 600.

A plurality of switchers 201, 103 and 107 are provided along a sheet transfer route to direct sheets P to a target transfer destination. The switcher 201 is provided between the receiving portion 150 and the folder 200 and switches among the routes guiding and not guiding sheets P to the folder 200. The puncher 300 is provided in the lower stream of the switcher 201 and punches filing holes in sheets P transferred from the receiving portion 150 and/or the folder 200. The switcher 103 is provided in the lower stream of the puncher 300 and switches among the routes guiding sheets P to the discharge tray 110, guiding sheets P to the post process tray 400, and directly guiding sheets P to the accumulation tray 600. The switcher 107 is provided in the lower stream of the switcher 103 and switches between the routes guiding sheets P to the discharge tray 110 and guiding to the post process tray 400.

Further, a plurality of sensors 102, 105, 108, 112, 118, 124, 225 and etc. are provided along a sheet transfer route, and these sensors detect sheets P so that the timings to drive and stop the respective portions of the post processing apparatus 100 could be appropriately adjusted.

Further, the post processing apparatus 100 according to this embodiment comprises a guide 160 that prevents discharge errors that may be caused when bundles of sheets, which are stapled (saddle-stitched) like magazines, are discharged on the accumulation tray 600. As shown in Figure, the guide 160 is a support and guide portion 125 that is movable back and forth and supports from below bundles of sheets discharged from the discharge rollers 122 and 123.

The accumulation tray 600 is movable upward and downward depending on amount of sheets P or amount of bundles of sheets P, which is heretofore known. As more sheets P or more bundles of sheets P are accumulated thereon, the accumulation tray 600 moves more downward.

As previously mentioned, the post processing apparatus 100 is capable of performing a post process (such as folding, punching or stapling) on a plurality of sheets P, and users arbitrarily select among these post processes via the operation panel 39 (shown in FIG. 3) of the image forming apparatus 10. For example, if a user selects the stapling mode and specifies a stapling position on sheets, sheets P discharged from the image forming apparatus 10 then received by the receiving portion 150 are transferred to the post process tray 400, then accumulated and jogged thereby. And then, a bundle of the sheets P, which is accumulated and jogged, is transferred by the transfer rollers to the stapler 500.

Meanwhile, the stapler 500 makes preparation for a post process, in other words, moves to an appropriate position to meet the stapling position on sheets, which is specified by the user. And when the stapler 500 finishes making preparation for a post process (when it finishes moving to the appropriate position), it performs stapling. Then, the stapled bundle of sheets is transferred by the transfer rollers to the accumulation tray 600 then discharged thereon.

A configuration of the post processing apparatus 100 is not limited to the one shown in FIG. 1 and FIG. 2, and various configurations can be arbitrarily employed for the post processing apparatus 100.

Figure 3:
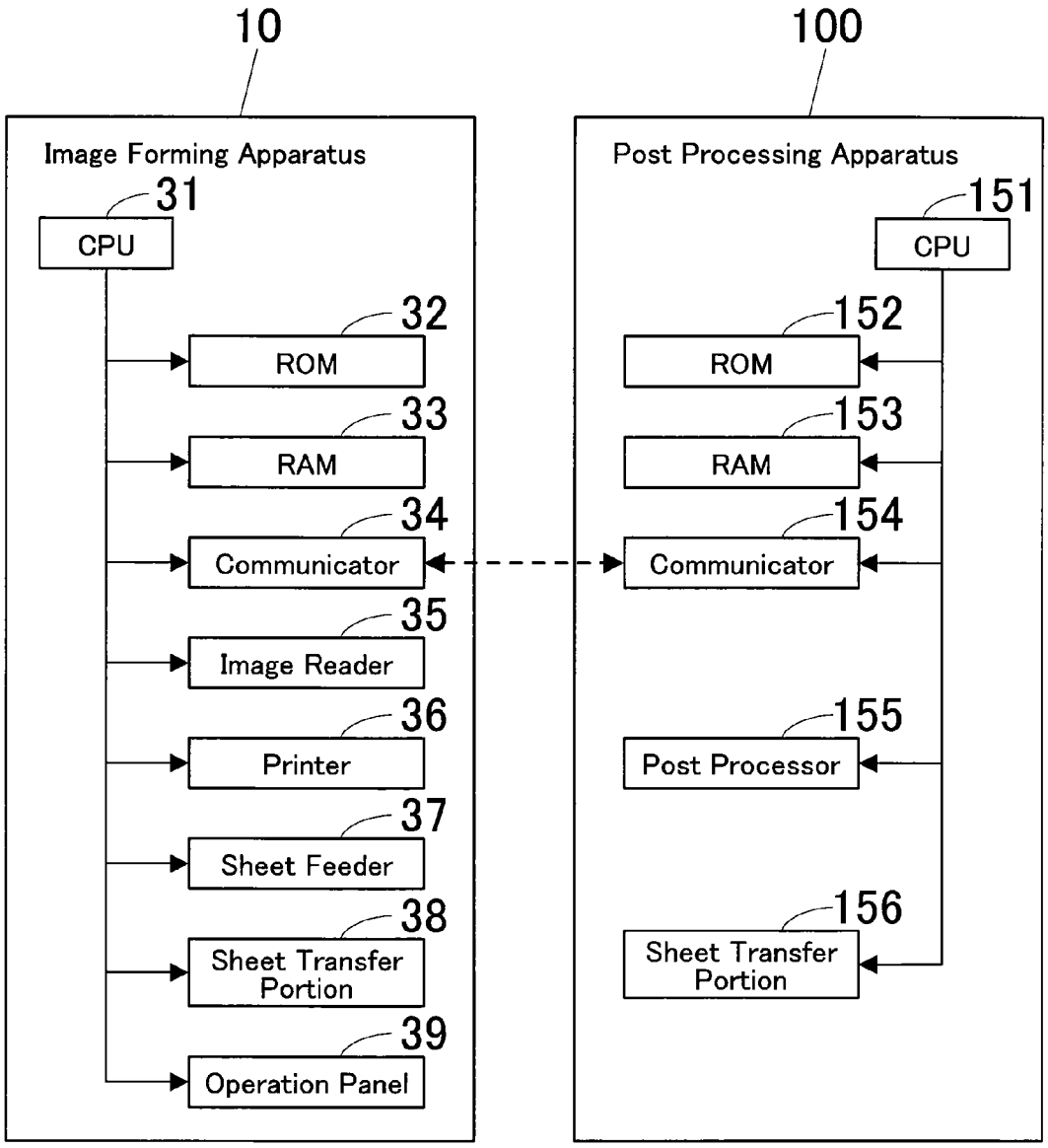
FIG. 3 is a block diagram schematically showing configurations of main portions of an image forming apparatus and a post processing apparatus.

FIG. 3 is a block diagram schematically showing a configuration of main portions of the image forming apparatus 10 and the post processing apparatus 100.

The image forming apparatus 10 comprises a CPU 31, a ROM 32, a RAM 33, a communicator 34, an image reader 35, a printer 36, a sheet feeder 37, a sheet transfer portion 38 and an operation panel 39.

The CPU 31 controls the entire image forming apparatus 10. Specifically in this embodiment, the CPU 31 controls the timing to feed sheets to the post processing apparatus 100, as described hereinafter.

The ROM 32 stores an operation program for the CPU 31 and other data therein. The RAM 33 provides an operation area for the CPU 31 to execute processing according to the operation program.

The communicator 34 exchanges data with the post processing apparatus 100.

The image reader 35 reads an image on a document and converts it into image data that is electronic data. The printer 36 prints on sheets, image data read out from a document by the image reader 35, print data or other data transmitted from an external device.

The sheet feeder 37 feeds sheets loaded in the sheet feed tray 19 to the printer 36, and eventually to the post processing apparatus 100. The sheet feeder 37 is the resist roller 17 in this embodiment. Under the control of the CPU 31, sheets are fed by the resist roller 17 at an appropriate timing.

The sheet transfer portion 38 transfers sheets loaded in the sheet feed tray 19 to the post processing apparatus 100, by way of the printer 36 and the sheet discharger 10*b*. The sheet transfer portion 38 comprises the plurality of transfer rollers 18 previously mentioned, and others.

The operation panel 39 is used by users to enter an operation mode, a process condition, and etc. of the image forming apparatus 10, and it also displays thereon a status of the apparatus, a message, and etc. The operation panel 39 comprises a key entry portion such as numeric keys, a start key and etc., and also a touch-panel display and others. Users select a post process such as stapling or other, and specify a stapling position on sheets by using the operation panel 39.

On the other hand, the post processing apparatus 100 comprises a CPU 151, a ROM 152, a RAM 153, a communicator 154, post processors 155 and a sheet transfer portion 156.

The CPU 151 controls the entire post processing apparatus 100. Specifically, the CPU 151 performs judgment and calculation for controlling the timing to feed sheets by the image forming apparatus 10, in this embodiment. Explanation about this operation will be detailed later.

The ROM 152 stores an operation program for the CPU 151 and other data therein. The RAM 153 provides an operation area for the CPU 151 to execute processing according to the operation program.

The communicator 154 exchanges data with the image forming apparatus 10.

Each of the post processor 155 performs a post process on sheets fed from the image forming apparatus 10 about each job. In this embodiment, the post processors 155 are the folder 200 for folding, the puncher 300 for punching holes, and the stapler 500 for stapling, as previously mentioned. The number of the post processor 155 does not always have to be more than one, and also can be only one.

The sheet transfer portion 156 transfers sheets P fed from the image forming apparatus 10, to a post-processing position where the post processor 155 performs a post process. As previously mentioned, the sheet transfer portion 156 comprises the transfer rollers 104, 106, 111, and etc.

Figure 4:
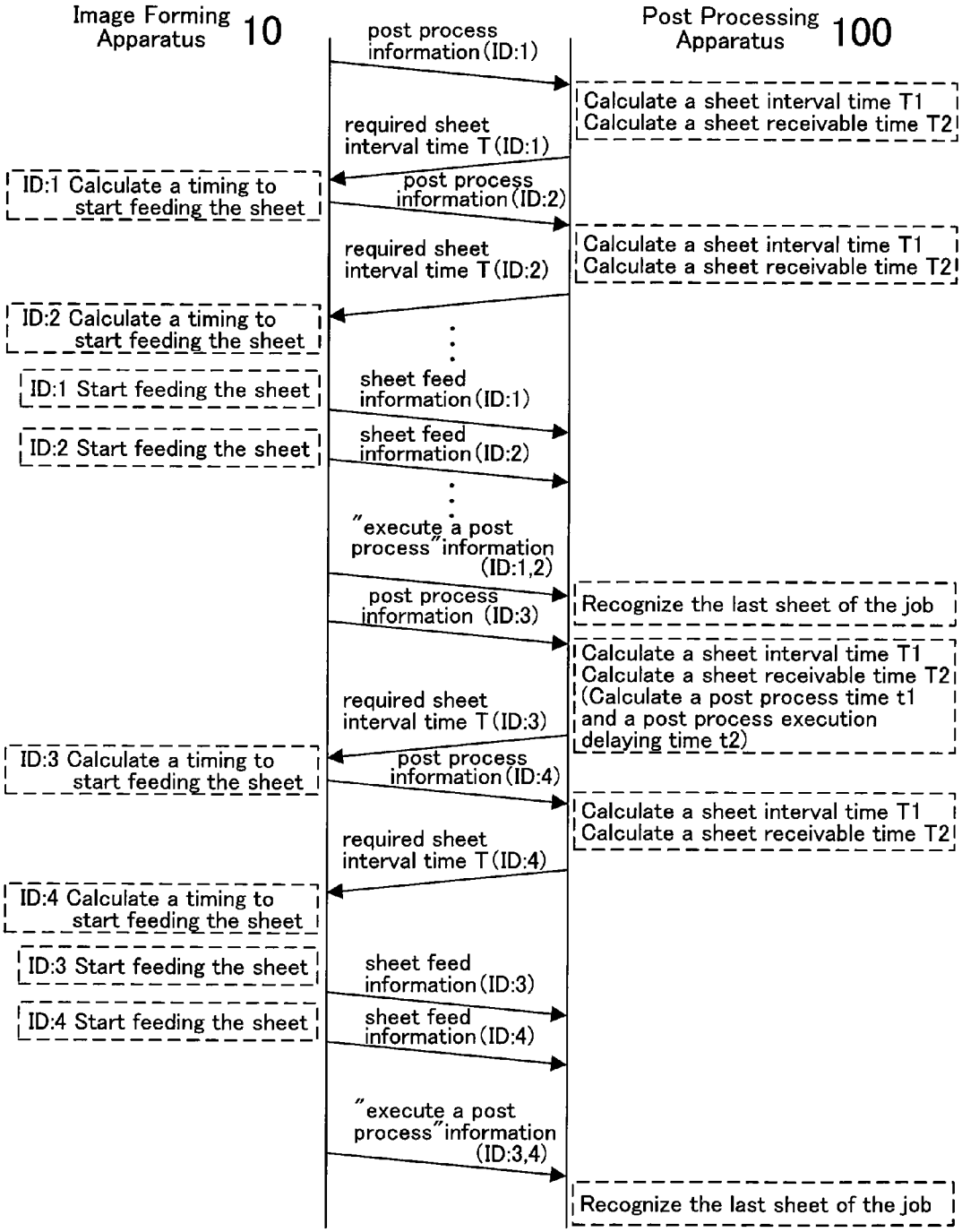
FIG. 4 is an explanatory view showing information exchanged between the image forming apparatus and the post processing apparatus.

FIG. 4 is a view showing information exchanged via the communicators 34 and 154, between the image forming apparatus 10 and the post processing apparatus 100, respectively.

When a user gives an instruction to execute a job to be post-processed, by selecting a post process mode among the predetermined ones then pressing a start button or other by using the operation panel 39, the image forming apparatus 10 transmits post process information to the post processing apparatus 100 about each sheet, in advance of feeding sheets to the post processing apparatus 100. The post process information includes information of a sheet size, a sheet feeding speed, a post process mode set in advance and others, which is necessary for the post processing apparatus 100 to perform a post process. Further, the post process information has an ID that is given to each sheet, and the post processing apparatus 100 identifies sheets by their IDs.

If the post processing apparatus 100 receives post process information, a sheet interval time T1 and a sheet receivable time T2 are calculated.

The sheet interval time T1 is an interval time calculated based on the distance from the rear end of a sheet P to the front end of a following sheet P, and the sheets P are fed by the sheet feeder 37 and transferred by the sheet transfer portion 38, and then discharged from the sheet discharger 10*b*, in the image forming apparatus 10. The sheet receivable time T2 is a time required for the post processing apparatus 100 from receiving a sheet until receiving a following sheet from the image forming apparatus 10.

After a sheet interval time T1 and a sheet receivable time T2 are calculated, these times are compared, and the longer time drawn as the comparing result is determined as a required sheet interval time T that is a sheet interval time required between a sheet and a following sheet. Then, information of the required sheet interval time T is transmitted to the image forming apparatus 10, with an ID issued about the following sheet.

The sheet interval time T1, the sheet receivable time T2 and the required sheet interval time T will be detailed later.

If the image forming apparatus 10 receives the required sheet interval time T from the post processing apparatus 100, an appropriate timing to start feeding a sheet is calculated based on the required sheet interval time T. Then, an image is started to be formed by the printer 36 and a sheet is started to be fed by the resist roller 17 at the calculated timing, under the control.

As shown in FIG. 4, the image forming apparatus 10 and the post processing apparatus 100 exchange post process information and required sheet interval times T about the top sheet (ID: 1) and a following sheet (ID: 2) of a job. Then, a timing to start feeding the top sheet and a timing to start feeding the following sheet are calculated respectively, and each of the sheets is fed at the calculated timing.

After each of the sheets is started to be fed, the image forming apparatus 10 transmits sheet feed information indicating that the sheet is already fed, to the post processing apparatus 100.

After the sheet feed information, the image forming apparatus 10 transmits to the post processing apparatus 100, "execute a post process" information about the last sheet of the job (ID: 2 in the example of FIG. 4), which indicates that the sheet is the last sheet of the job. By receiving the "execute a post process" information, the post processing apparatus 100 recognizes that the sheet (ID: 2) about which received the latest sheet feed information, is the last sheet of the job.

If another job is executed right after the job, the post processing apparatus 100 receives post process information about the top sheet of the following job, right after receiving the "execute a post process" information. Then the post processing apparatus 100 calculates a post process time t1 and a post process execution delaying time t2 about the sheets (IDs: 1 and 2) to be post-processed, which are already started to be fed, then calculates a sheet receivable time T2. The longer one between the calculated sheet receivable time T2 and the calculated sheet interval time T1 is determined as the required sheet interval time T, and the required sheet interval time T is transmitted to the image forming apparatus 10.

The post process time t1 and the post process execution delaying time t2 will be detailed later.

As describe above regarding operations performed about each sheet, each sheet P is fed to the post processing apparatus 100 at an appropriate timing under the control of the image forming apparatus 10.

Figure 5:
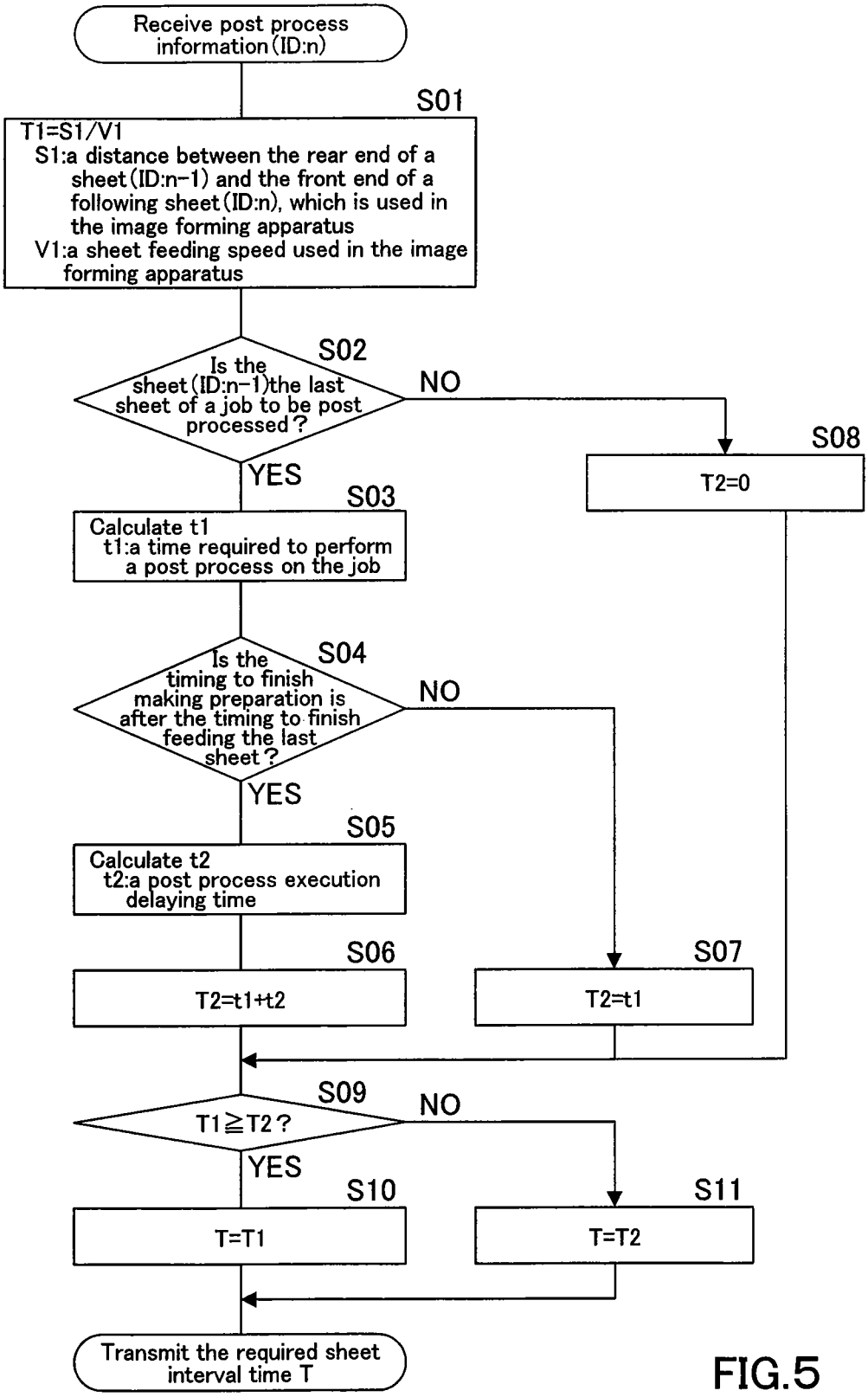
FIG. 5 is a flowchart showing a procedure executed in the post processing apparatus if post process information is received from the image forming apparatus.

FIG. 5 is a flowchart showing a procedure executed if the post processing apparatus 100 receives post process information from the image forming apparatus 10, and the procedure includes calculating a sheet interval time T1 and a sheet receivable time T2, determining a required sheet interval time T, and transmitting the required sheet interval time T to the image forming apparatus 10.

This procedure is executed by the CPU 151 of the post processing apparatus 100 according to a program stored in a recording medium such as the ROM 152.

If post process information is received, under the control of the CPU 151, a sheet interval time T1 is calculated in Step S01. In this embodiment, a sheet interval between sheets, which is controlled by the image forming apparatus 10, is acquired from a table preliminarily stored in the ROM 152 or other, based on a sheet size included in the post process information. Then, a sheet interval time T1 is calculated based on the acquired sheet interval and sheet feeding speed information included in the post process information.

In other words, if a sheet interval between the rear end of a sheet (ID: n−1) and the front end of a following sheet (ID: n) (a distance between the sheets), which is used in the image forming apparatus 10, is defined as S1 and a sheet feeding speed used in the image forming apparatus 10 is defined as V1, a sheet interval time T1 is calculated by the formula: T1=S1/V1.

Instead of acquiring from the table a sheet interval between the sheets, which is used in the image forming apparatus 10, the post processing apparatus 100 also can be configured to acquire a sheet interval between the sheets from sheet interval information that is included in the post process information received from the image forming apparatus 10.

In Step S02, depending on whether or not "execute a post process" information is received, it is judged whether or not the sheet (ID: n−1) is the last sheet of a job to be post processed. If it is the last sheet of a job to be post-processed (YES in Step S02), a post process time t1 is calculated in Step S03, since the top sheet of a following job cannot be received until a post process is completed.

The post process time t1 is a time required from the start until the end of a post process. Specifically in this embodiment, it is a sum of a working time of the post processor 155 to perform a post process and a time required for the processed sheet(s) to be discharged on the accumulation tray 600 or other.

The post processor 155 has to make preparation for a post process. For example, if stapling is performed as a post process, the stapler 500 sometimes has to move, and when the stapler 500 finishes moving to an appropriate position (finishes making preparation), the post processor 155 is prepared to perform a post process. If the post processor 155 is prepared in this way above before the last sheet of a job to be post-processed arrives at the post processing position and ready to be post-processed, the post processor 155 starts performing a post process as soon as the last sheet of a job to be post-processed arrives at the post processing position. On the other hand, if the post processor 155 is not prepared before the last sheet of a job to be post-processed arrives at the post processing position and ready to be post-processed, the post processor 155 does not start performing a post process and waits until prepared. The judgment whether or not preparation of the post processor 155 is finished before the last sheet of a job to be post-processed arrives at the post processing position so that the post processor 155 could perform a post process, depends on a sheet size, the number of sheets, etc. of the job.

In Step S04, it is judged whether or not the second timing Tb to finish making preparation for a post process is after the first timing Ta to finish feeding the last sheet of a job to be post-processed to the post processing position so that a post process could be performed. If it is judged that the second timing Tb is after the first timing Ta (YES in Step S04), a post process execution delaying time t2 is calculated in Step S05. The post process execution delaying time t2 is a time difference (Tb−Ta) between the second timing Tb and the first timing Ta.

After a post process execution delaying time t2 is calculated, the routine proceeds to Step S06, and a sheet receivable time T2 is determined as t1+t2 (T2=t1+t2). Then the routine proceeds to Step S09.

If it is judged that the second timing Tb is before the first timing Ta (NO in Step S04), a post process can be immediately started at the first timing Ta. And a sheet receivable time T2 is determined as t1 (T2=t1) in Step S07, since the post process execution delaying time t2 is zero. Then the routine proceeds to Step S09.

On the other hand, if it is judged that the sheet (ID: n−1) is not the last sheet of a job to be post processed (NO in Step S02), a post process is not performed between the sheets. And a sheet receivable time T2 is determined as 0 (T2=0) in Step S08, since the post process time t1 and the post process execution delaying time t2 are both zero.

In Step S09, it is judged whether or not the sheet interval time T1 calculated in Step S01 is greater than or equal to the sheet receivable time T2 calculated in Step S06, S07 or S08.

If the sheet interval time T1 is greater than or equal to the sheet receivable time T2 (YES in Step S09), a required sheet interval time T is determined as the sheet interval time T1 about the following sheet (ID: n) in Step S10, since a post process would be successfully performed even if the sheets are fed to the post processing apparatus 100 at a certain sheet interval that is used in the image forming apparatus 10. If the sheet interval time T1 is less than the sheet receivable time T2 (NO in Step S09), a required sheet interval time T is determined as the sheet receivable time T2 about the following sheet (ID: n) in Step S11, since the following sheet would happen to be fed to the post processing apparatus 100 before a post process is completed, if the sheets are fed to the post processing apparatus 100 at a certain sheet interval that is used in the image forming apparatus 10.

Under the control of the CPU 151, information of the required sheet interval time T that is determined about the following sheet (ID: n) in this way above, is transmitted to the image forming apparatus 10 via the communicator 154.

Figure 6:
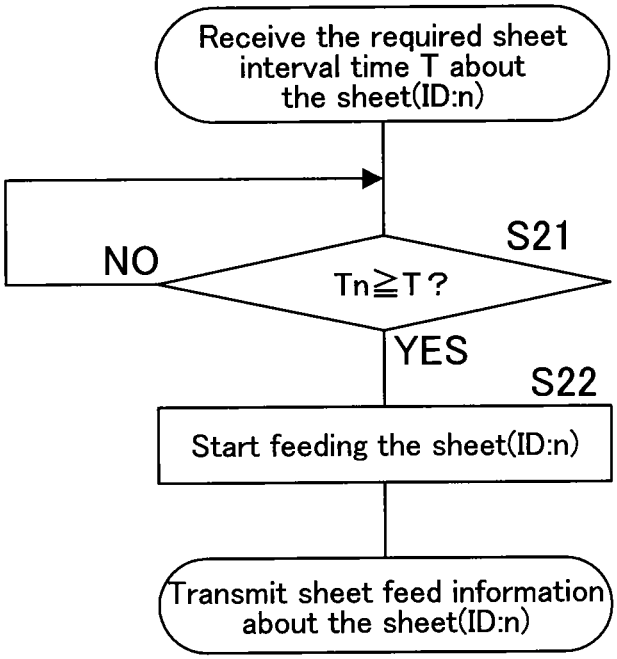
FIG. 6 is a flowchart showing a procedure executed in the image forming apparatus if a required sheet interval time is received from the post processing apparatus.

If the image forming apparatus 10 receives information of the required sheet interval time T from the post processing apparatus 100 via the communicator 34, a procedure shown in a flowchart of FIG. 6 is executed about the following sheet (ID: n), based on the required sheet interval time T.

This procedure is executed by the CPU 31 of the image forming apparatus 10 according to a program stored in a recording medium such as the ROM 32.

In Step S21, under the control of the CPU 31, it is judged whether or not a sheet interval time Tn between the rear end of a sheet (ID: n−1) and the front end of a following sheet (ID: n), is greater than or equal to the required sheet interval time T. If the sheet interval time Tn is less than the required sheet interval time T (YES in Step S21), the routine waits until it is greater than or equal thereto. If the sheet interval time Tn is greater than or equal to the required sheet interval time T (YES in Step S21), under the control of the CPU 31, the following sheet (ID: n) is started to be fed by the resist roller 17 (Step S22). And then, sheet feed information is transmitted to the post processing apparatus 100.

As described above in this embodiment, if the second timing Tb to finish making preparation of the post processor 155 for performing a post process on a job to be post-processed, is after the first timing Ta to finish feeding the last sheet of the job to the post processing position so that the post processor 155 could perform a post process, then a post process execution delaying time t2 that is a time difference (Tb−Ta) between the second timing Tb and the first timing Ta is calculated, and a sheet receivable time T2 is determined as a sum of a post process time t1 and the post process execution delaying time t2. If the sheet receivable time T2 is greater than a sheet interval time T1 in the image forming apparatus 10, the image forming apparatus 10 controls the sheet feed timing so that the top sheet of a following job could be fed to the post processing position of the post processing apparatus 100 after the sheet receivable time T2.

In other words, the start of a post process is delayed by the post process execution delaying time t2 to make preparation for a post process, and the top sheet of a following job is fed to the post processing apparatus 100 at an appropriate timing that is calculated based on the delay, which would prevent inconvenience caused if the top sheet of a following job happens to be fed to the post-processing position before a post process is completed.

On the other hand, if the second timing Tb is before the first timing Ta, a sheet receivable time T2 depends only on a post process time t1. And if the sheet receivable time T2 is greater than a sheet interval time T1 in the image forming apparatus 10, the image forming apparatus 10 controls the sheet feed timing so that the top sheet of a following job could be fed to the post processing position of the post processing apparatus 100 after the sheet receivable time T2 (the post process time t1).

Including the cases where sheets of one same job are fed, if the sheet receivable time T2 is less than or equal to a sheet interval time T1 in the image forming apparatus 10, a post process would be successfully performed even if the sheets are fed at a sheet interval time T1 in the image forming apparatus 10. Thus, the sheets are fed to the post processing apparatus 100 at the fastest speed, which would contribute to productivity.

According to this embodiment, the image forming apparatus 10 can feed sheets at a certain interval that is appropriately adjusted depending on a time required to make preparation for a post process, and thereby achieves effective sheet feed control.

Figure 7:
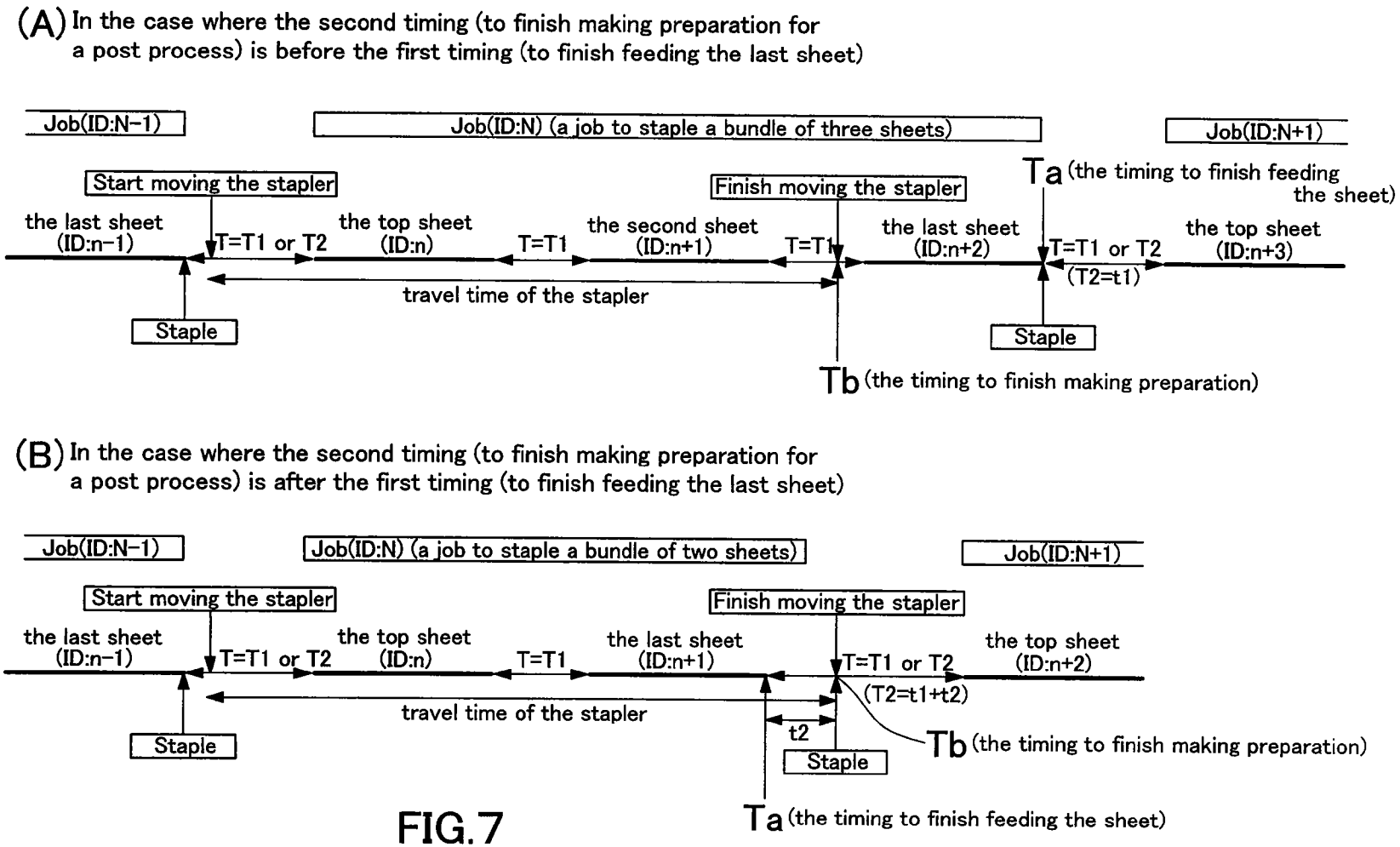
FIG. 7 is a timing chart to explain this embodiment of the present invention.

Advantages of this embodiment will be further detailed with reference to FIG. 7. In FIG. 7, stapling is performed as a post process.

FIG. 7 (A) shows an example in which the second timing Tb to finish making preparation of the post processor 155 for performing a post process on a job to be post-processed, is before the first timing Ta to finish feeding the last sheet of the job to the post processing position so that a post process could be performed.

As shown in FIG. 7 (A), the stapler 500 performs stapling on a job (ID: N−1), and then starts moving to make preparation for stapling on a following job (ID: N).

The job (ID: N) is given about three sheets (ID: n, n+1, n+2), and the three sheets are individually fed by the image forming apparatus 10, in number order from the top sheet to the last sheet. A sheet interval between the sheets is determined based on a sheet interval time T1 that is used in the image forming apparatus 10.

In this embodiment, the second timing Tb is before the first timing Ta, in other words, the stapler 500 finishes moving to an appropriate position to perform a post process before the last sheet (ID: n+2) arrives at the post processing position. In this case, the stapler 500 starts stapling at the first timing Ta.

After the longer one between a post process time t1 and the sheet interval time T1 that is used in the image forming apparatus 10, the top sheet (ID: n+3) of a following job (ID: N+1) is started to be fed.

FIG. 7 (B) shows an example in which the second timing Tb is after the first timing Ta.

As shown in FIG. 7 (B), the stapler 500 performs stapling on a job (ID: N−1), and then starts moving to make preparation for stapling on another job (ID: N).

The job (ID: N) is given about two sheets (ID: n, n+1), and the two sheets are individually fed by the image forming apparatus 10, in number order from the top sheet to the last sheet. A sheet interval between the sheets is determined based on a sheet interval time T1 in the image forming apparatus 10.

In this embodiment, the second time Tb is after the first timing Ta, in other words, the stapler 500 does not finish moving to an appropriate position before the last sheet (ID: n+1) arrives at the post processing position. In this case, the stapler 500 has to wait for the post process execution delaying time T2, until the second timing Tb when the stapler 500 finishes moving. And then, the stapler 500 starts stapling at the second timing Tb.

Subsequently, the last sheet (ID: n+1) of the job (ID: N) is fed. And after the longer one between a sum of the post process execution delaying time t2 and the post process time t1, and the sheet interval time T1 in the image forming apparatus 10, the top sheet (ID: n+3) of a following job (ID: N+1) is started to be fed. Thus, this embodiment would prevent inconvenience caused if the top sheet of a following job happens to be fed to the post-processing position before the stapler 500 completes stapling on a previous job, and the sheets are fed to the post processing apparatus 100 at the fastest speed, which would contribute to productivity.

Described above is just one embodiment of the present invention, and the present invention is not limited to this embodiment.

In this embodiment, sheets P are fed to the post processing apparatus 100 by the resist roller 17 of the image forming apparatus 10 at an appropriate timing under the control. Although, it can be also configured such that the sheet feeder 37 is provided along a sheet transfer route, e.g. provided in the sheet discharger 10*b* or other of the image forming apparatus 10, and sheets P are fed to the post processing apparatus 100 by the sheet feeder 37 at an appropriate timing under the control.

Further, it can be also configured such that a sheet feeder capable of suspending sheets fed from the image forming apparatus 10 is provided in the post processing apparatus 100, and sheets are fed by the sheet feeder of the post processing apparatus 100 at an appropriate timing under the control.

These processes described above, which are performed in the post processing apparatus 100 under the control of the CPU 151, will be further explained with reference to a flowchart shown in FIG. 8.

Figure 8:
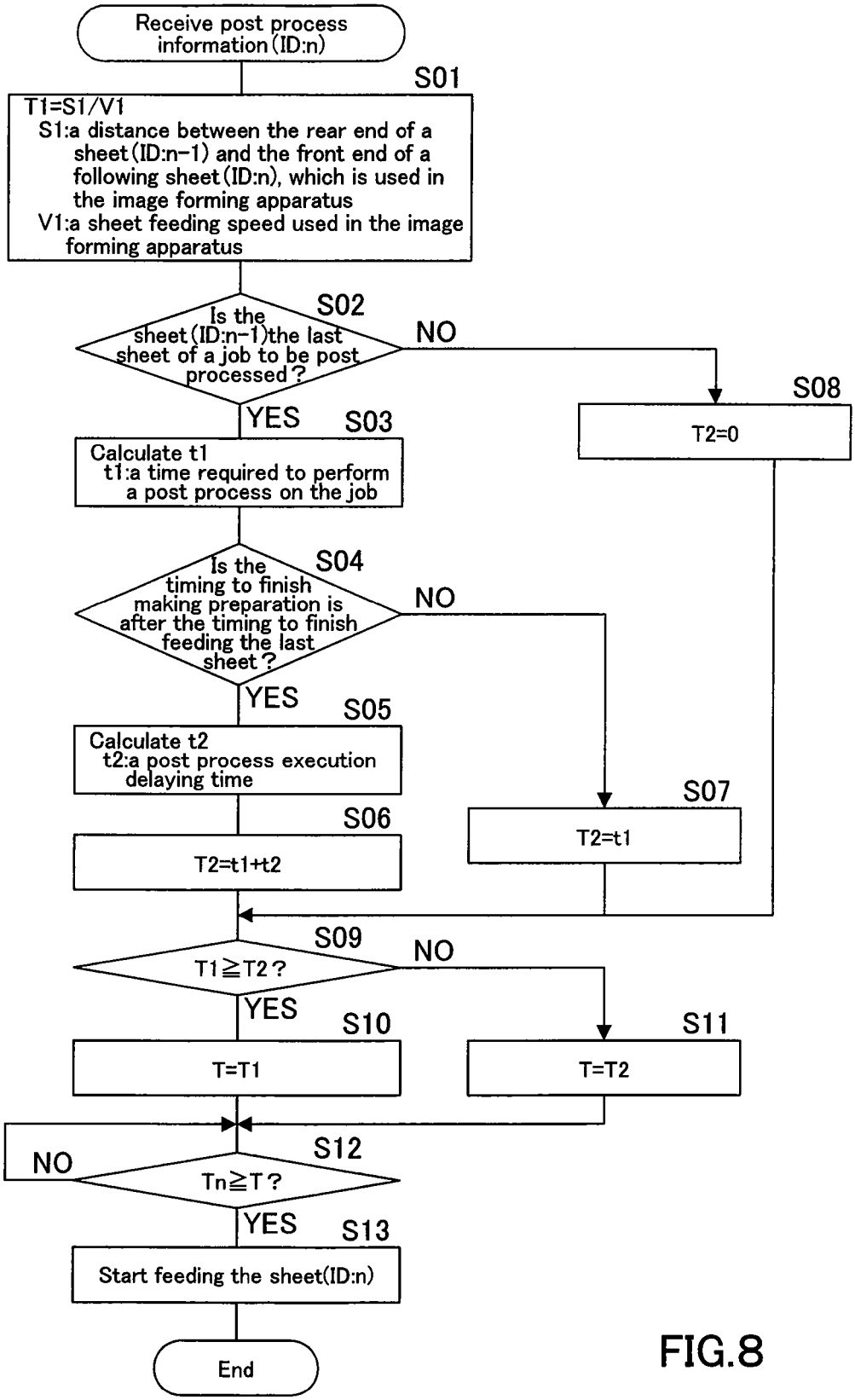
FIG. 8 is a flowchart showing a procedure executed in the post processing apparatus if post process information is received from the image forming apparatus, according to another embodiment of the present invention.

Since Steps S01 through S11 in FIG. 8 are exactly the same as Steps with the same numbers in the flowchart of FIG. 5, explanation about Steps S01 through S11 will be omitted.

In Step S12, under the control of the CPU 151, a time difference Tn between the rear end of a sheet (ID: n−1) and the front end of a following sheet (ID: n), is compared to the required sheet interval time T determined in Step S10 or S11. If the time difference Tn is less than the required sheet interval time T (NO in Step S12), the routine waits until it is greater than or equal to the required sheet interval time T. If the time difference Tn is greater than or equal to the required sheet interval time T (YES in Step S12), under the control of the CPU 151, a following sheet (ID: n) is started to be fed by the sheet feeder.

In this embodiment above, a required sheet interval time T is determined about each sheet in the post processing apparatus 100 then transmitted to the image forming apparatus 10. Although, it can be also configured such that a required sheet interval time T is determined only about the top sheet of a following job, which is to be fed right after the last sheet of a previous job, since sheets of one same job are fed under the control, primarily at a sheet interval time T1 that is used in the image forming apparatus 10.

Further, in this embodiment, a sheet interval time T1 that is used in the image forming apparatus 10 and a sheet receivable time T2 are calculated, then a required sheet interval time T is determined based on these times, in the post processing apparatus 100. Although, it can be also configured such that information of the post process time t1 and the post process execution delaying time t2 is transmitted from the post processing apparatus 100 to the image forming apparatus 10, and a sheet interval time T1 and a sheet receivable time T2 are calculated, then a required sheet interval time T is determined based on these times, in the image forming apparatus 10.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g. of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to". In this disclosure and during the prosecution of this application, means-plus-function or step-plus-function limitations will only be employed where for a specific claim limitation all of the following conditions are present In that limitation: a) "means for" or "step for" is expressly recited; b) a corresponding function is expressly recited; and c) structure, material or acts that support that structure are not recited. In this disclosure and during the prosecution of this application, the terminology "present invention" or "invention" may be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure and during the prosecution of this case, the following abbreviated terminology may be employed: "e.g." which means "for example", and "NB" which means "note well".

What is claimed is:

1. An image forming system, comprising:

an image forming apparatus that is equipped with a printer that prints an image on a sheet; and a post processing apparatus that performs a post process on a first job before performing a post process on a second job, each job comprising one or a plurality of sheets each carrying thereon an image printed by the image forming apparatus, and wherein:

a sheet feeder that feeds a sheet of the first job before a sheet of the second job to be post-processed to a post processing position in the post processing apparatus;

a timing judger that judges which is before/after, a first timing to finish feeding the last sheet of the first job to the post processing position so that a post process could be performed, or a second timing to finish making preparation of the post processing apparatus to perform a post process on the first job;

a delaying time calculator that calculates a post process execution delaying time specific to the post processing apparatus and based only on the first job, which is a time difference between the first timing and the second timing, if the second timing is after the first timing; and a sheet feed controller that controls the sheet feeder to control sheet feed timing of the top sheet of the second job to the post processing position by using the post process execution delaying time calculated by the delaying time calculator, if the timing judger judges that the second timing is after the first timing, wherein the sheet feeder feeds the second job to the post processing position after feeding the first job to the post processing position.

2. The image forming system as recited in claim 1, further comprising:

a comparator that compares a sum of a post process time required for the post processing apparatus to perform a post process from its start until its end, and the calculated post process execution delaying time, to a sheet interval time determined based on the sheet interval and the sheet feeding speed in the image forming apparatus, and wherein:

the sheet feed controller controls sheet feed timing of the top sheet of the following job, by making the sheet interval time required between the last sheet of the job to be post-processed and the top sheet of the following job, equivalent to the longer time drawn by the comparator, if the timing judger judges that the second timing is after the first timing.

3. The image forming system as recited in claim 2, wherein the post process time corresponds to a sum of a working time required to perform the post process and a time required to discharge a post-processed sheet from the post processing position.

4. The image forming system as recited in claim 1, further comprising:

a comparator that compares a post process time required for the post processing apparatus to perform a post process from its start until its end, to a sheet interval time determined based on the sheet interval and the sheet feeding speed in the image forming apparatus, and wherein:

the sheet feed controller controls sheet feed timing of the top sheet of the following job, by making the sheet interval time required between the last sheet of the job to be post-processed and the top sheet of the following job, equivalent to the longer time drawn by the comparator, if the timing judger judges that the second timing is before the first timing.

5. The image forming system as recited in claim 4, wherein the post process time corresponds to a sum of a working time required to perform the post process and a time required to discharge a post-processed sheet from the post processing position.

6. The image forming system as recited in claim 1, wherein the timing judger judges which is before/after, the first timing or the second timing, based on information transmitted from the image forming apparatus, which indicates that the sheet fed from the image forming apparatus is the last one of the job to be post-processed.

7. A sheet feed control method, comprising:

feeding to a post processing position of a post processing apparatus that performs a post process on a first job before performing a post process on a second job, each job comprising one or a plurality of sheets each carrying thereon an image printed by an image forming apparatus;

judging which is before/after, a first timing to finish feeding the last sheet of the first job to be post-processed to the post processing position so that a post process could be performed, or a second timing to finish making preparation of the post processing apparatus to perform a post process on the first job;

calculating a post process execution delaying time specific to the post processing apparatus and based only on the first job, which is a time difference between the first timing and the second timing, if it is judged that the second timing is after the first timing; and controlling the feeding to the post processing position by controlling sheet feed timing of the top sheet of a second job to the post processing position by using the post process execution delaying time calculated in the previous step, if it is judged the second timing is after the first timing, wherein the second job is fed to the post processing position after the first job is fed to the post processing position.

* * * * *